United States Patent [19]

Alberts

[11] 4,188,855

[45] Feb. 19, 1980

[54] METHOD OF AND APPARATUS FOR AUTOMATICALLY RESIZING AND DECAPPING FIRED CARTRIDGE CASES

[75] Inventor: Melvin R. Alberts, Upper Saddle River, N.J.

[73] Assignee: Alberts Corporation, Franklin Lakes, N.J.

[21] Appl. No.: 905,212

[22] Filed: May 12, 1978

[51] Int. Cl.[2] ..... F42B 33/02

[52] U.S. Cl. ..... 86/36; 86/45; 86/46; 86/23

[58] Field of Search ..... 86/23, 37, 45, 46, 36

[56] References Cited

U.S. PATENT DOCUMENTS

| | | | |
|---|---|---|---|
| 3,153,976 | 10/1964 | Linder | 86/45 X |
| 3,610,090 | 10/1971 | Corcoran | 86/45 |
| 4,078,472 | 3/1978 | Simpson | 86/23 |

*Primary Examiner*—Leland A. Sebastian

*Attorney, Agent, or Firm*—Sommers & Sommers

[57] ABSTRACT

This invention, relating to the art of resizing and decapping fired cartridge cases, comprises a novel method of and apparatus for automatically and safely resizing spent cartridge cases having primer caps, including means for automatically resizing the cases and clearing the case of the spent primer therein, in a highly efficient, automatic procedure, uniformly restoring cartridge cases for reuse. Pursuant to the invention means are provided which automatically orient the fired cases and feed them to a case receiving station from which they are sequentially advanced to a registration station, where swaging or sizing of the outside dimensions of the case to their original dimensions is effectuated and the case is decapped and reclaimed for reuse; the so resized and decapped case is displaced from the apparatus simultaneously automatically on positioning the next case at the registration station for repetition of the procedure.

26 Claims, 7 Drawing Figures

METHOD OF AND APPARATUS FOR AUTOMATICALLY RESIZING AND DECAPPING FIRED CARTRIDGE CASES

BACKGROUND OF THE INVENTION

This invention generally relates to the art of reclamation of ammunition and more particularly to the reclamation of fired cartridge cases wherein, when fired, a firing pin strikes a primer which ignites the powder, which burns very rapidly and generates large volumes of gas, building up pressures, expanding the brass case and allowing the bullet to be expelled. The brass case is elastic and opens up to allow the bullet to be projected; it also springs back, but often becomes distorted and does not return sufficiently to provide sufficient tension to retain a bullet for repeated operation. This is partly due to the fact that the chamber in which the case is fired is oversized and also that the case is distorted in the firing procedure. Pursuant to this invention these and other difficulties encountered in this art are overcome by the invention herein described, wherein the casing is automatically restored and returned to its original standard dimensions, to retain the bullet in the case.

IN THE DRAWINGS

In the drawings, wherein similar parts are correspondingly numbered:

FIG. 1 is a perspective view of an apparatus embodying the invention.

FIG. 2 is an enlarged, sectional plan view of parts of the invention taken at line 2—2 of FIG. 1, FIG. 3 is a fragmentary end elevational view, taken at line 3—3 of FIG. 2, FIG. 4 is a schematic view of parts correspondingly numbered in FIGS. 1-3, FIG. 5 is a vertical elevational, partly sectional view of sizing and decapping means which may be used pursuant to the invention, shown prior to assembly, FIG. 6 is a similar view, showing said parts assembled and ready for the decapping procedure, and FIG. 7 shows said parts on completion of the decapping procedure.

DESCRIPTION OF PREFERRED EMBODIMENT OF THE INVENTION

Figure 1:
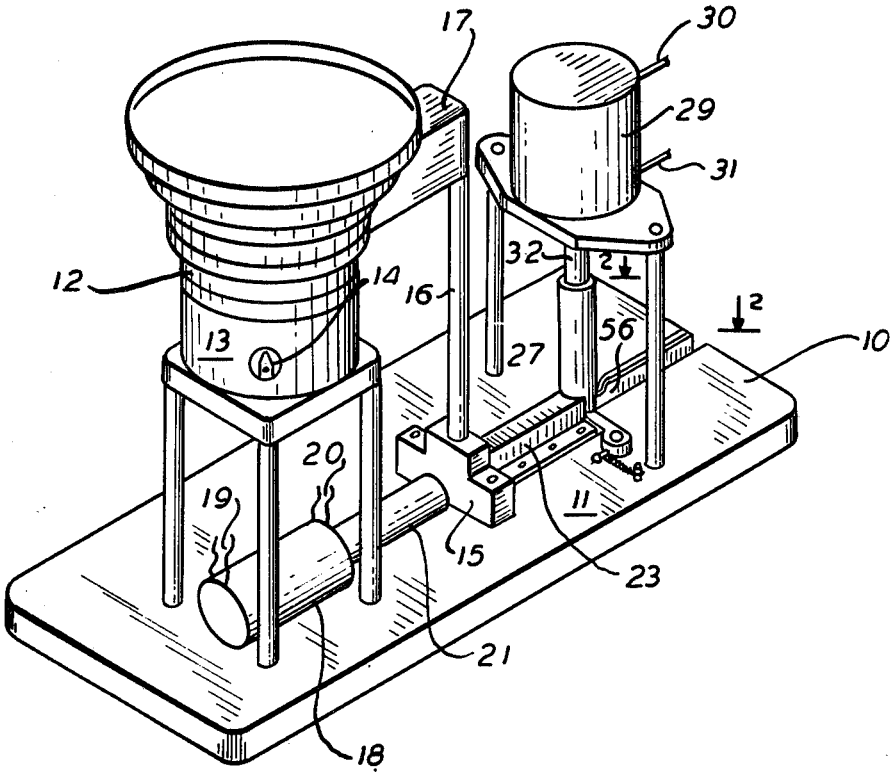

A preferred embodiment of the invention, as shown in the drawings, comprises (FIG. 1) an apparatus 10 including a support plate 11, a vibrating feed bowl 12 adapted to be rotated by any suitable means, such as the motor 13 having a suitable control knob 14 for turning the motor on and off and for regulating the rate of rotation of the rotor and thus the bowl 12 keyed to the motor; the motor is connected to a suitable source of current. A case receiving housing 15 is (FIGS. 1, 4) positioned on the support plate 11 and connected to the feed bowl 12 as by a tube 16. Pursuant to the invention, spent cartridge cases are deposited into the feed bowl 12, which may be spirally or otherwise formed interiorly to centrifugally and serially automatically advance casings positioned therein into and through a connecting fixture 17 and into the tube 16, for deposition sequentially singly into the housing 15, pursuant to the invention. A pneumatic cylinder 18 is mounted on support plate 11 and connected to a suitable compressor or other pressure source, as by lines 19, 20 and is provided with a piston to thus pneumatically reciprocate a plunger or rod 34, (FIG. 2) through the housing 21, for moving a case 35 so positioned in the housing 15 (from tube 16) to a sizing point or station 22 (FIG. 2) as through a channel or track 36 which may be formed of spaced parallel rails 55 or other means on support plate 11. The invention may be utilized for the restoration of cartridges such as exemplified herein by the case 35 (FIGS. 5, 2) having a cap 25 at one end thereof, said cap having an aperture 26 (FIG. 2) which, in the original manufacture, is filled with the (37) FIG. 7 primer to be cleared therefrom in the reclamation procedure of the invention herein described and claimed.

The decapping procedure of this invention may be performed automatically and efficiently pursuant to apparatus and means (FIGS. 2, 5, 6, 7) including a case-swaging die body 27, provided with an internal ring 28 which may be a bronze bushing, said die body being connected, as at 27' to piston rod 32 (FIG. 1) of a pneumatic cylinder 29 having lines 30, 31 for actuating said cylinder, to reciprocate the pneumatic piston 32 and thus the case-swaging die body 27, for achieving the sizing procedure, below further described.

The air pressure cylinders 18, 29 may be individually controlled by regulators and a pressure switch may be provided so that, when the pressure in the system falls below predetermined levels, the operation will be automatically terminated; suitable timing means may be used to sequentially coordinate the movement of components of the apparatus of the invention to achieve the sequential feeding, sizing and decapping procedures described and claimed herein.

The air cylinders 18 and 29 are preferrably automatically operated in timed relation to each other so that upon completion of the sizing operation the case 35 will be displaced or moved from the sizing station 22 and the next case (which had previously been deposited at the housing 15) will be advanced to the sizing station; thus the operation is repeated automatically sequentially. The advancing of a case from the positioning to the sizing stations 15,22 (FIGS. 1,2) respectively, results in ejection of the case 35, which had previously been sized and decapped at the station 22, through aperture 56 (FIG. 2) as below described, the case 35 having been moved by pusher rod 34, actuated by the piston (to which it is connected) of air cylinder 18 from station 15 to station 22, pushing the decapped case 35 beyond said station 22 as at 57, FIG. 2, and into collector means 56 (FIG. 2).

Figure 2:
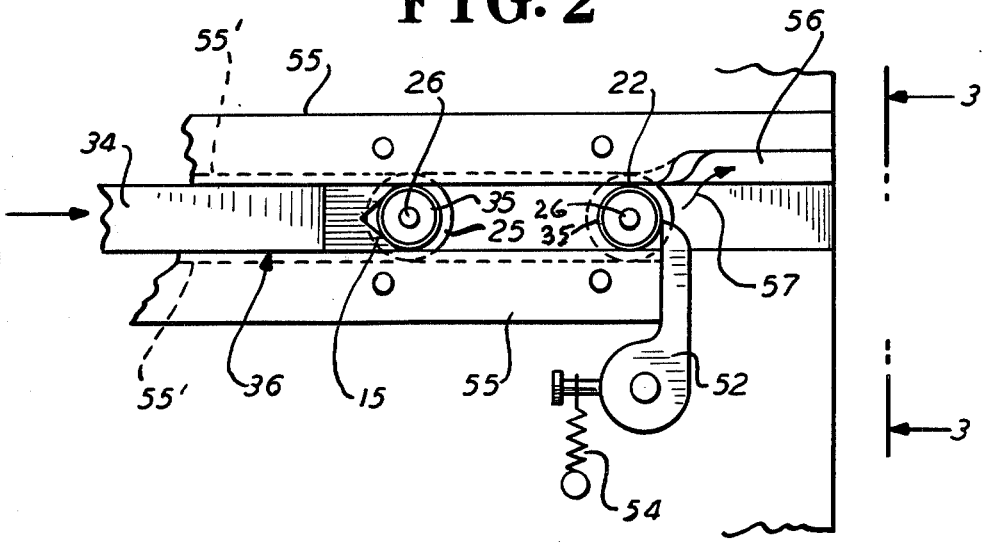
Figure 3:
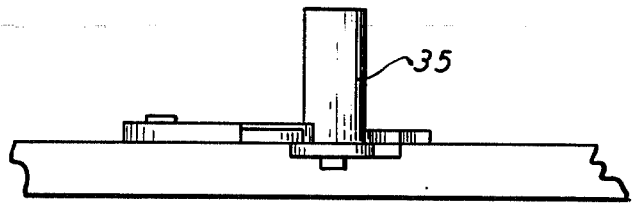
Figure 4:
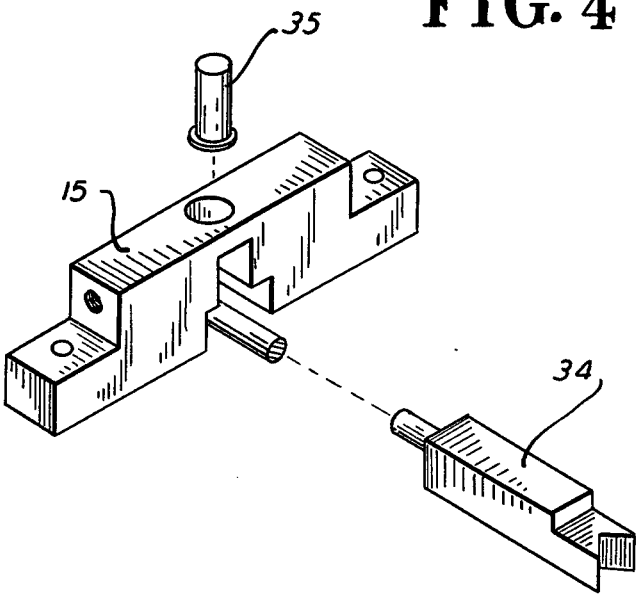
Figure 5:
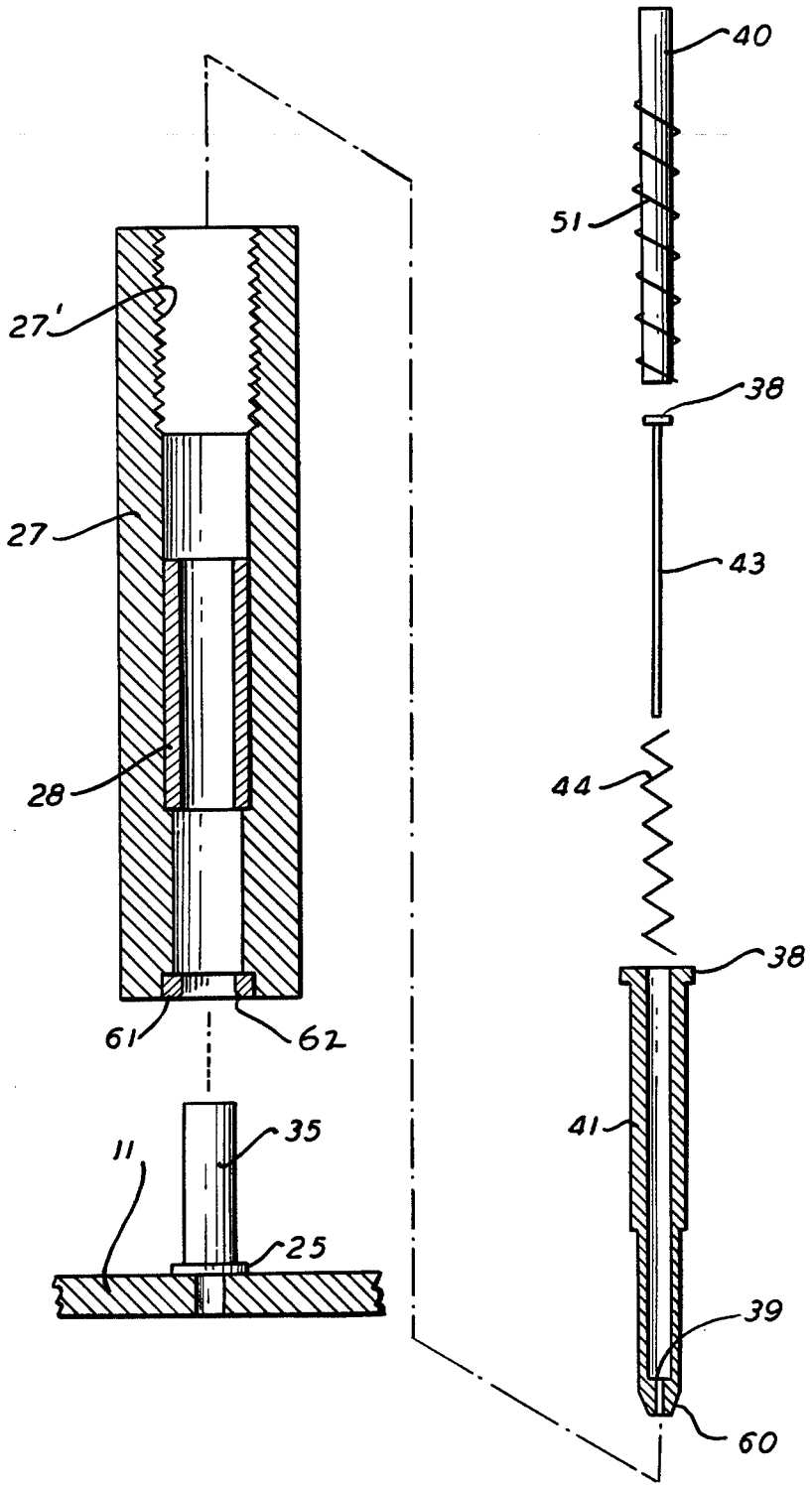
Figure 6:
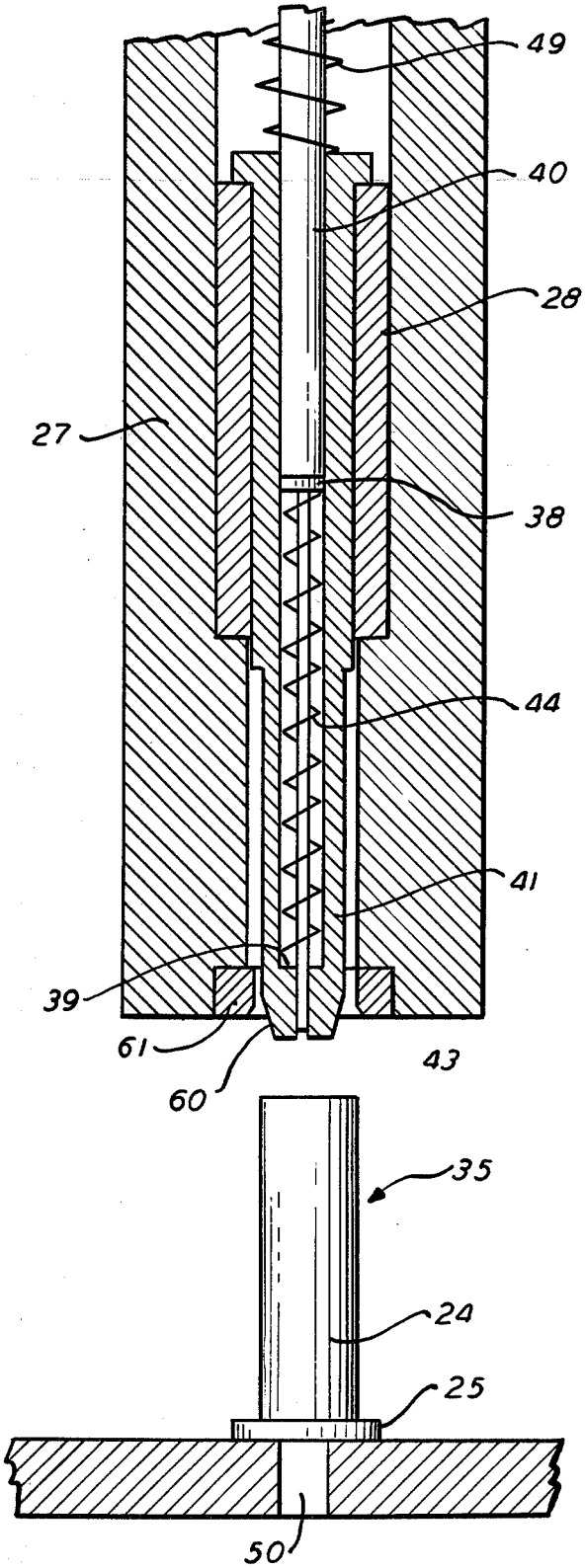

As shown in FIGS. 2,3 and 4, the plunger 34, when actuated, moves the case 35 from case receiving station to the sizing station 22, at which point the case encounters stop means, such as a pawl 52, spring urged to a position of interference with movement of the case. Pawl 52 may engage the end of a rail 55 or other stop means limiting movement of the pawl in one direction (for stopping movement of the case) while enabling movement of the pawl in the opposite direction, against the tension of spring or other means 54 yieldably holding the pawl at the sizing station, to permit displacement of case sized and cleared of primer, as below further described. Latch or pawl 52 acts as a perimeter stop to locate and center the cartridge case under the sizing die. The pusher or slide rod 34 pushes the incoming case or shell, which pushes the de-primed cartridge case out of the parallel guide rails 55, provided with longitudinal grooves 55' throughout their length; said grooves lead to deflector aperture 56 (FIG. 2). Thus the sized case is moved past the latch 52 at an angle 57 and into discharge aperture 56. The displaced, sized, cap thus is preferably deflected as at 57 (FIG. 2) automatically through a collection aperture or other collector means 56 and into a collector apparatus therebelow.

Pursuant to the invention a hardened steel operating sleeve 41 is movably positioned in die liner 28 (which may be an "Oilite" or bronze bushing) (FIGS. 6,7) and normally projects toward or slightly out of the free lower end of the case swedging die body 27.

On actuation of the pneumatic cylinder 29 the pneumatic piston 32 moves the die body 27 (secured thereto as at 27', FIG. 5) downwardly. The operating sleeve 41 is preferably slightly tapered as at 60 (FIG. 6) at its free end so that said tapered end will (FIG. 7) enter the case 35 and center the case for sizing by the die, supporting the case interiorly. As die 27 is moved downwardly for the sizing operation, the sleeve 41 will move into the case 35 and the primer knockout pin 43 will be moved downwardly through the sleeve 41, which reinforces the interior of case 35 in the sizing operation.

Figure 7:
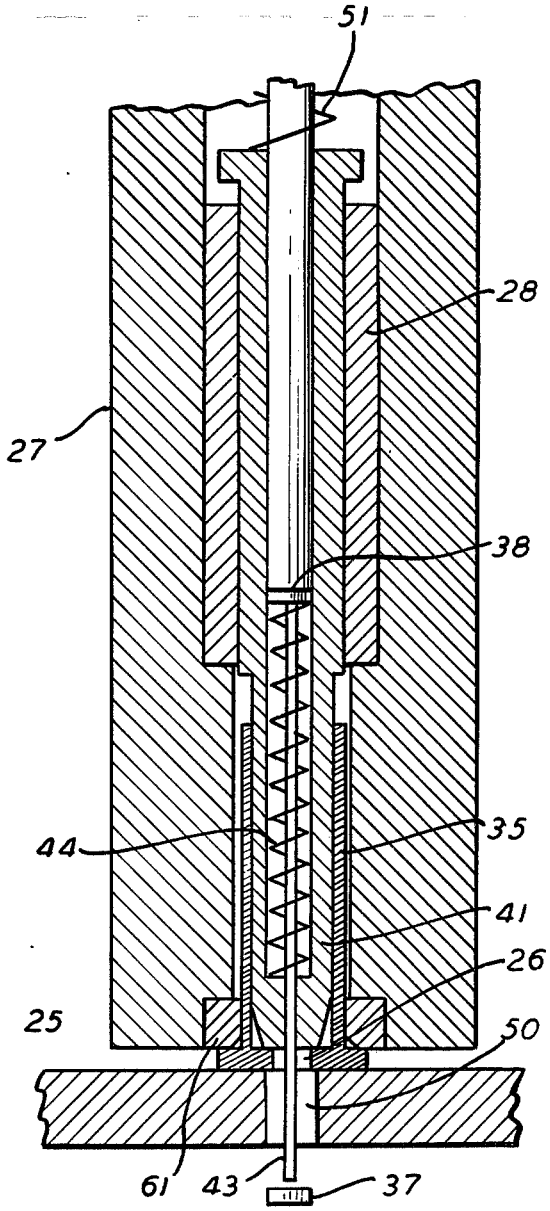

As above described, the case 35 is (FIG. 2) provided with an aperture 26 and receives primer 37 therein in the original manufacture of the case. A primer decapping or knockout pin 43 is movably positioned in sleeve 41 and is normally retracted therein by means such as the spring 44 engaging the head 38 of the primer knockout pin at one end and engaging an internal shoulder 39 of sleeve 41 (FIG. 6) at the other end. An operating rod or pin 40 is (FIGS. 6, 7) movably positioned in the operating sleeve or bushing 41 and, at its lower end, engages the head 38 of the decapping or knockout pin, the sleeve 41 being urged downwardly in the die as by a spring 49. The operating pin 40 moves downwardly with the die body 27 and moves the knockout pin 43 downwardly and through the aperture 26 of case (FIG. 7). Thus, the free end 61 of the case-swaging die body 27, which free end may be in the form of a hardened apertured ring or disc (of suitable material such as carbide) fixed into a recess in the die body, swages and sizes (FIG. 7) the case body, while operating sleeve or bushing 41 interiorly reinforces the case body 35. The knockout pin 43 passes through the aperture 26 of case cap and ejects the primer 37 therefrom and into any desired collector means connected to primer receiving aperture 50 (FIG. 7).

RESUME' OF THE INVENTION

Pursuant to the invention, the vibrating feed bowl 12 orients the fired cases 25 to feed them singly into tube 16 head first and thereby to station 15. The case is then pushed by feed plunger or pusher rod 34 (FIG. 2) between guide rails 55 to stop or pawl 52. The pusher rod 34 is notched (FIG. 2) and cut away to better grip and center the case therein. Then sizing die 27, mounted on the end of air cylinder rod 32, moves down (FIG. 7). Its free end, constricted or reinforced as at 60 by an inserted ring, swedges the outside dimensions on the case 35 back to original size while the die moves down and pin 43 decaps the spent primer 37; on the upstroke it clears and the next case is then fed to repeat the operation; the incoming case displaces the reclaimed case and discharges it (through aperture 56, FIG. 2).

The die that sizes the case may be a compound die made up of several parts: the die body 27, may preferably be of steel with bronze or "Oilite" liner 28 interiorly therein. A hardened steel operating sleeve 41 carries the decapping pin 43 having a head 38 at its upper end; sleeve 41 is slidably mounted in liner 28. A spring 44 is mounted with pin 43, in sleeve 41. Spring 44 urges the knockout pin 43 upwardly in the sleeve 41. Atop the decapping pin 43 of sleeve 41 is the operating rod 40 which is positioned between the decapping pin 43 and the piston rod 32. The operating rod 40 holds the decapping pin 43 down and the operating sleeve slides up (FIG. 7); the decapping pin passes through primer flash hole 26 of the case and knocks the primer out. Spring 49, surrounding the operating rod 40, is a return spring for the operating sleeve 41.

The parts may be so proportioned and designed that the sleeve 41 and the decapping pin normally (FIG. 6) project out of the die 27 slightly; as the die comes down around the case (FIG. 7) the sleeve 41 contacts the case head interiorly and remains stationary at this point. The air cylinder continues down and the sleeve bushing 41, remaining stationary, the decapping pin 43 is exposed; it is pushed by operating rod 40 through the case aperture 26 and knocks out the primer 37 therein.

When the operating sleeve 41 (FIG. 6) is inserted into the die body 27 with a decapping pin 43 and spring 44 on operating sleeve 41 (and with operating rod 40 atop head 39 of decapping pin 43) the operating rod 40 bears against the piston rod 32 of the air cylinder 23; in effect the named parts function as a single unit. When the cylinder 29 is in its full down position, the combined lengths of the described parts is great enough so that the decapping pin 43 will (FIG. 7) go through the sized case, through the primer discharge aperture 50 and eject the spent primer and push it completely free of the case and into any discharge collecting unit or receptacle therebelow.

The operating sleeve surrounds and shields and protects the decapping pin so that any foreign material in the case will not break the pin.

In addition to providing an accurate rapid, automatic and safe procedure, the invention safeguards against damage or wedging due to foreign material which might locate inside a case and which otherwise might break any decapping pin. If a very large quantity of foreign matter has accumulated in the shell such as in conventional practice might distort and break a pin, case 35, pursuant to the invention, would be kicked out and the next operating cycle would be resumed, without interrupting the operation or damage to the parts.

The apparatus may be provided with a switch for power and a power-on light to indicate that condition and another light to indicate low air pressure, and a pressure switch. Thus the operator may regulate the amount of air in the system through a regulator. The pressure switch would operate so that if the pressure in the apparatus falls below a predetermined level the operation will automatically shutdown. If, for example, the fuse on the air compressor source blows out and air pressure is thus lost, that will automatically shut down the apparatus rather than have it spew out unized cases. Cams may be provided mounted on a motor actuated shaft, one to operate the feed cylinder 18 and the other the sizing cylinder 29. The cams may be rotated by motor or otherwise to time their relative relationship to each other.

The operating sleeve 41 end is tapered as at 60 to enter and center the case 35 before the carbide or other hardened ring 61 or end of die body 27 telescopes and swages and sizes the case. The inner lower edge 62 (FIG. 6) of the ring is tapered to provide clearance and prevent wedging of the parts when (FIG. 7) the ring contacts the cap 25. The operating sleeve 41 is proportioned to fit snugly inside the die liner 28 so that when the case is in position and the die starts down, the operating sleeve projects out of the die, its lead taper 60 assuring that the case will be properly lined up with the die.

The operating rod 40 is slidably positioned in the operating sleeve 41 and is movable downwardly with die 27 therein in the downward stroke (FIG. 7) of the die 27, moving the decapping pin through the aperture 26 of case 35, displacing the spent primer 37. Sleeve 41, whose head normally rests on the upper end of the liner 28 in the die body 27, under pressure of spring 49, leaves said upper end of the internal ring 28 in the final position of the die (FIG. 7) at which its swedging ring 61 contacts the cap end of case 35.

The terms "cartridge", "cases" and "cartridge cases" as used herein shall be deemed to include ammunition cases and devices of any form which may be manufactured or filled with primers or other substances by use of the process or apparatus of this application or covered in a claim or claims thereof.

The invention has been exemplified above in exemplary embodiments thereof. Other embodiments made, within the scope and spirit of the invention and the claims appended, shall be deemed to be within the spirit and scope of the invention and covered thereby.

I claim:

1. The method of automatically resizing spent cartridge cases having apertured caps, at a case resizing station, comprising:

(a) feeding a case to the case resizing station, (b) swaging the case exteriorly thereof, and (c) concurrently reinforcing the case interiorly thereof while so swaging the case exteriorly thereof.

2. In the method of automatically resizing spent cartridge cases as set forth in claim 1, the further step comprising:

projecting a pin through said primer cap aperture, clearing primar therefrom.

3. In the method of automatically resizing spent cartridge cases as set forth in claim 1, the further step comprising:

centering and positioning the case for the swaging step.

4. In the method of automatically resizing spent cartridge cases as set forth in claim 1, the further step comprising:

projecting a pin through said apertured cap of said case, thus clearing the case of the primer, and collecting the primer so cleared therefrom.

5. In the method of automatically resizing spent cartridge cases as set forth in claim 1, the further step comprising:

displacing the case so swaged from said resizing station and positioning another case at said station.

6. In the method of automatically resizing spent cartridge cases as set forth in claim 1, the further step comprising:

displacing the case so swaged from said resizing station and positioning another case in said registration station, simultaneously.

7. In the method of automatically resizing spent cartridge cases as set forth in claim 1, the further step comprising:

displacing and clearing the primer from the apertured cap, and collecting the primer so cleared.

8. In the method of automatically resizing spent cartridge cases as set forth in claim 1, the further step comprising:

centering the case to be so swedged, supporting the case interiorly, thereof and swaging the case exteriorly while it is so centered and supported.

9. An apparatus for automatically resizing spent cartridge cases having primer caps, comprising:

(a) means for feeding a case to a case resizing station, (b) means for resizing and swaging the case exteriorly thereof, (c) means for reinforcing the case interiorly thereof while so swaging the case exteriorly, and (d) means for centering the case in said swaging and resizing means.

10. In an apparatus for automatically sizing spent cartridge cases as set forth in claim 9, said means for so interiorly reinforcing the case comprising a member movably receivable interiorly of said case.

11. In an apparatus for automatically resizing spent cartridge cases as set forth in claim 9, said means for so reinforcing the case interiorly comprising a tubular member receivable interiorly of said case, said tubular member being tapered to facilitate its being so received in said case interiorly and so centering the case for so swaging and resizing the case.

12. In an apparatus for automatically resizing spent cartridge cases as set forth in claim 9, said means for so reinforcing the case interiorly comprising a tubular member, and said swaging means comprising a tubular member proportioned to telescopically exteriorly engage the case.

13. In an apparatus for automatically resizing spent cartridge cases as set forth in claim 9, a pin, and means for projecting said pin through said means supporting said case interiorly and through said case primer cap, to clear the case of primer.

14. In an apparatus for automatically sizing spent cartridge cases as set forth in claim 9, a pin movably positioned for projection through said means supporting said case interiorly and through said case primer cap, and means for projecting said pin through said means supporting said case interiorly and through said case primer cap, to clear the case of primer.

15. An apparatus for automatically resizing spent cartridge cases having apertured primer caps, at a resizing station in the apparatus, comprising:

(a) means for supporting the case at said resizing station, (b) means reciprocably disposed in said apparatus relative to the resizing station for engaging the case exteriorly at said station and thereby resizing and swedging the case, (c) a decapping pin disposed in the die and reciprocable means, movable therewith, for movement through the apertured case to thereby displace the primer therefrom, and (d) means surrounding the pin and protecting the same.

16. In an apparatus for automatically sizing spent cartridge cases as set forth in claim 15, said reciprocable means in said apparatus including a die so reciprocably disposed,
said die having a free end, and
a ring positioned at the free end of the die for swedging the case on engagement therewith.

17. In an apparatus for automatically sizing spent cartridge cases as set forth in claim 15,
said reciprocable means in said apparatus including a die so reciprocably disposed,
said die having a free end, and
a ring positioned at the free end of the die and proportioned for swaging the case on engagement therewith,
said ring being a carbide ring.

18. In an apparatus for automatically sizing spent cartridge cases as set forth in claim 15,
said reciprocable means in said apparatus including a die so reciprocably disposed,
said die having a free end, and
a ring positioned at the free end of the die and extending inwardly of the die and proportioned for swedging the case on engagement therewith.

19. In an apparatus for automatically sizing spent cartridge cases as set forth in claim 15,
said reciprocable means in said apparatus including a die so reciprocably disposed,
said die having a free end, and
a ring positioned at the free end of the die and proportioned for swaging the case on engagement therewith,
said ring being made of material harder than that of the case,
a sleeve movably disposed in the die, and
means movably positioning the decapping pin in the sleeve.

20. In an apparatus for automatically sizing spent cartridge cases as set forth in claim 15,
said reciprocable means in said apparatus including a die so reciprocably disposed,
said die having a free end,
a ring positioned at the free end of the die and proportioned for swaging the case on engagement therewith,
the inner lower edge of the ring being outwardly tapered.

21. In an apparatus for automatically sizing spent cartridge cases as set forth in claim 15,
said means so reciprocably disposed in said apparatus including a die so reciprocably disposed,
said die having a free end, and
a ring positioned at the free end of the die and proportioned for swaging the case on engagement therewith,
the lower end of the sleeve being tapered to enter the case and reinforce the same while the die swages the case exteriorly.

22. In an apparatus for automatically sizing spent cartridge cases as set forth in claim 15,
said reciprocable means so disposed in said apparatus including a die so reciprocably disposed,
said die having a free end, and
a ring positioned at the free end of the die and proportioned for swaging the case on engagement therewith,
said die having an internal liner,
said sleeve being movably positioned in the liner and thereby so positioned in the die.

23. In an apparatus for automatically sizing spent cartridge cases as set forth in claim 22,
said reciprocable means in said apparatus including a die so reciprocably disposed,
said die having a free end,
a ring positioned at the free end of the die and proportioned for swaging the case on engagement therewith,
said internal liner of the die extending partly interiorly thereof, and having an upper end, and
said sleeve having an upper head portion complementary to said upper end of said liner and normally resting thereon, and
means engaging the said upper end of said sleeve and normally urgaging the same onto the upper end of said liner.

24. In an apparatus for automatically sizing spent cartridge cases as set forth in claim 15,
said means so reciprocably disposed in said apparatus including a die so reciprocably disposed,
said die having a free end,
a ring positioned at the free end of the die and proportioned for swaging the case on engagement therewith,
said pin having a head at the upper end thereof, and
means engaging said pin head and sleeve and normally urging the pin upwardly in the sleeve.

25. In an apparatus for automatically sizing spent cartridge cases as set forth in claim 15,
said means so reciprocably disposed in said apparatus including a die so reciprocably disposed,
said die having a free end,
a ring positioned at the free end of the die and proportioned for swedging the case on engagement therewith,
said pin having a head at the upper end thereof,
means engaging said pin head and sleeve and normally urging the pin upwardly in the sleeve,
and means engaging said decapping pin and movable with said die.

26. In an apparatus for automatically sizing spent cartridge cases as set forth in claim 15,
said means so reciprocably disposed in said apparatus including a die so reciprocably disposed,
said die having a free end,
a ring positioned at the free end of the die and proportioned for swaging the case on engagement therewith,
said pin having a head at the upper end thereof,
means engaging said pin head and sleeve and normally urging the pin upwardly in the sleeve,
and means movably positioned in said sleeve, and engaging said decapping pin, engaging said pin for movement therewith on movement of said die.

* * * * *